US011378285B2

(12) United States Patent
Qiu

(10) Patent No.: US 11,378,285 B2
(45) Date of Patent: Jul. 5, 2022

(54) OUTDOOR UNIT FOR AIR CONDITIONER AND AIR CONDITIONER

(71) Applicants: GD MIDEA HEATING & VENTILATING EQUIPMENT CO., LTD., Foshan (CN); MIDEA GROUP CO., LTD., Foshan (CN)

(72) Inventor: Shilin Qiu, Foshan (CN)

(73) Assignees: GD MIDEA HEATING & VENTILATING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 19 days.

(21) Appl. No.: 16/471,862

(22) PCT Filed: Jun. 12, 2017

(86) PCT No.: PCT/CN2017/087956
§ 371 (c)(1),
(2) Date: Jun. 20, 2019

(87) PCT Pub. No.: WO2018/120659
PCT Pub. Date: Jul. 5, 2018

(65) Prior Publication Data

US 2020/0003434 A1 Jan. 2, 2020

(30) Foreign Application Priority Data

Dec. 30, 2016 (CN) ..... 201621489193.2

(51) Int. Cl.
*F24F 1/06* (2011.01)
*F24F 1/00* (2019.01)
*F25B 45/00* (2006.01)

(52) U.S. Cl.
CPC ..... *F24F 1/06* (2013.01); *F24F 1/00* (2013.01); *F25B 45/00* (2013.01)

(58) Field of Classification Search
CPC ..... F24F 1/00; F24F 1/06; F24F 1/56; F25B 45/00; F25B 2345/00; F25B 2345/001; F25B 2345/002; F25B 2345/006
See application file for complete search history.

(56) References Cited

U.S. PATENT DOCUMENTS 6,971,244 B2 * 12/2005 Domyo ..... C09K 5/045 62/114
2004/0124289 A1 * 7/2004 Yamamoto ..... F16K 15/205 239/600

(Continued)

FOREIGN PATENT DOCUMENTS

CN 201463121 U 5/2010
CN 202747484 U 2/2013

(Continued)

OTHER PUBLICATIONS

International Search Report and Written Opinion dated Sep. 11, 2017.

*Primary Examiner* — Joseph F Trpisovsky
(74) *Attorney, Agent, or Firm* — Dilworth & Barrese, LLP.; Michael J. Musella, Esq.

(57) ABSTRACT

An outdoor unit (100) for an air conditioner and the air conditioner are disclosed. The outdoor unit (100) for the air conditioner includes: a housing (1), a FREON charging nozzle (14), and a connector assembly. The FREON charging nozzle (14) is disposed in the housing (1); the connector assembly has a first end connected to the FREON charging nozzle (14) and a second end extending out of the housing (1).

14 Claims, 3 Drawing Sheets

(56) References Cited

U.S. PATENT DOCUMENTS

| | | | | |
|---|---|---|---|---|
| 2009/0107161 | A1* | 4/2009 | Jang | F24F 1/56<br>62/259.1 |
| 2010/0276622 | A1* | 11/2010 | Tanaka | F16K 51/00<br>251/318 |
| 2015/0040446 | A1* | 2/2015 | Nakasu | G09F 3/02<br>40/625 |
| 2017/0059189 | A1* | 3/2017 | Lim | F24F 1/26 |

FOREIGN PATENT DOCUMENTS

| | | | |
|---|---|---|---|
| CN | 105805992 | A | 7/2016 |
| JP | 5526770 | Y2 | 6/1980 |
| TW | 201546406 | A | 12/2015 |

* cited by examiner

OUTDOOR UNIT FOR AIR CONDITIONER AND AIR CONDITIONER

The present disclosure claims priority of Chinese Patent Application No. 201621489193.2 as filed on Dec. 30, 2016, the entire disclosure of which is hereby incorporated by reference as a part of the present disclosure. No new matter is added.

FIELD

The present disclosure relates to a technical field of household appliances, and more particularly to an outdoor unit for an air conditioner, and an air conditioner.

BACKGROUND

In the related art, when installation personnel install an outdoor unit of an air conditioner, vacuuming operation is required after a piping system is welded. As the vacuuming operation takes a long time, the installation personnel may usually leave the installation site temporarily, and in order to prevent animals or other impurities from entering the outdoor unit, the installation personnel needs to cover the outdoor unit. However, a vacuum pump is connected to a stop valve or a refrigerant charging valve through pipes, so a panel of the outdoor unit cannot be assembled back to cover the outdoor unit, which thus can only be temporarily covered by paper sheets or other things, and the panel can be assembled back after the vacuuming operation is completed and the refrigerant is added. Moreover, during maintenance, it is necessary to disassemble the panel of the outdoor unit to detect the system pressure of the running outdoor unit of the air conditioner. In particular, many outdoor units have large sized panels, and the panel adopts a split structure in an up-and-down direction, in which case an upper panel and a lower panel need to be disassembled separately for maintenance, thereby complicating the operation and lowering the maintenance efficiency.

SUMMARY

Embodiments of the present disclosure aim to solve at least one of the technical problems in the related art. To this end, an objective of the present disclosure is to propose an outdoor unit for an air conditioner, which simplifies processes of detection, installation and maintenance, and improves efficiencies of detection, installation and maintenance.

Another objective of the present disclosure is to propose an air conditioner having the above outdoor unit.

The outdoor unit for the air conditioner according to a first aspect of the present disclosure includes: a housing; a FREON charging nozzle provided in the housing; and a connector assembly having a first end connected with the FREON charging nozzle and a second end extending out of the housing.

For the outdoor unit according to the embodiments of the present disclosure, since the first end of the connector assembly is connected with the FREON charging nozzle and the second end of the connector assembly extends out of the housing, the FREON charging nozzle can be guided from an inner side of the housing to an outer side of the housing through the connector assembly. As a result, in a process of detecting the system pressure, vacuuming, or adding a refrigerant, it is no longer necessary to disassemble a panel, thereby simplifying the processes of detection, installation and maintenance and improving the efficiencies of detection, installation and maintenance.

Additionally, the outdoor unit for the air conditioner according to the present disclosure may also have the following additional technical features.

According to some embodiments of the present disclosure, the connector assembly includes a communication tube having a first end provided with a first connector and a second end provided with a second connector, the first connector is connected with the FREON charging nozzle, and the second connector extends out of the housing.

Specifically, the housing is provided with a lateral plate, the lateral plate is provided with an opening portion, and the second connector extends out of the housing through the opening portion.

According to some embodiments of the present disclosure, the opening portion has an edge provided with at least one limiting groove, and the communication tube extends into the limiting groove and is fitted with the limiting groove.

Optionally, a plurality of limiting grooves are provided and spaced apart in a length direction of the opening portion.

According to some embodiments of the present disclosure, the outdoor unit further includes a cover plate detachably connected with the lateral plate to cover the opening portion.

Optionally, the cover plate is connected with the lateral plate through a screw or a snap.

According to some embodiments of the present disclosure, the first connector is threadedly connected with the FREON charging nozzle.

Optionally, the communication tube is configured as a copper tube.

The air conditioner according to a second aspect of the present disclosure includes the outdoor unit according to the first aspect of the present disclosure.

For the air conditioner according to the second aspect of the present disclosure, the installation and maintenance efficiencies of the air conditioner is improved by providing the outdoor unit according to the first aspect of the present disclosure.

Additional aspects and advantages of embodiments of the present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of embodiments of the present disclosure will become apparent and more readily appreciated from the following descriptions made with reference to the drawings, in which.

Figure 1:
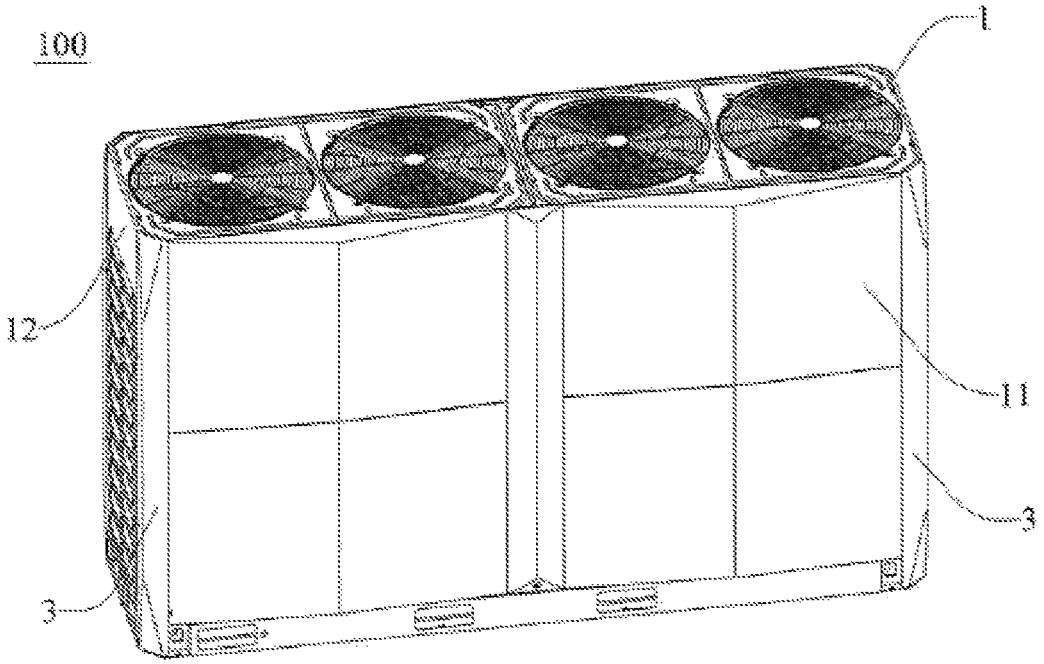
FIG. 1 is a perspective view of an outdoor unit for an air conditioner according to embodiments of the present disclosure.

REFERENCE NUMERALS outdoor unit 100,
housing 1, panel 11, lateral wall 12, lateral plate 13, opening portion 131, FREON charging nozzle 14, stop valve 15,
communication tube 21, first connector 22, second connector 23, connector cap 231, fixing member 232,
cover plate 3.

DETAILED DESCRIPTION

Embodiments of the present disclosure will be described in detail below and examples of the embodiments will be illustrated in the drawings. The same or similar elements and the elements having same or similar functions are denoted by like reference numerals throughout the description. The embodiments described below with reference to the drawings are illustrative and used to generally understand the present disclosure, and shall not be construed to limit the present disclosure.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or position relationship as then described or as shown in the drawings under discussion. These relative terms are for convenience and simplification of description and do not indicate or imply that the present disclosure have a particular orientation, or be constructed and operated in a particular orientation. Thus, these terms shall not be construed to limit the present disclosure. In addition, terms such as "first" and "second" are used herein for purpose of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the description of the present disclosure, it should be understood that, unless specified or limited otherwise, the terms "mounted," "connected," "coupled," and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

An outdoor unit 100 for an air conditioner according to embodiments of a first aspect of the present disclosure includes a housing 1, a FREON charging nozzle 14, and a connector assembly. The FREON charging nozzle 14 is disposed in the housing 1. The connector assembly has a first end connected with the FREON charging nozzle 14 and a second end extending out of the housing 1.

For the outdoor unit 100 for the air conditioner according to the embodiments of the present disclosure, since the first end of the connector assembly is connected with the FREON charging nozzle 14 and the second end of the connector assembly extends out of the housing 1, the FREON charging nozzle 14 can be guided from an inner side of the housing 1 to an outer side of the housing 1 through the connector assembly. As a result, in a process of detecting the system pressure, vacuuming, or adding a refrigerant, it is no longer necessary to disassemble a panel 11, thereby simplifying processes of detection, installation and maintenance and improving the efficiencies of detection, installation and maintenance.

The outdoor unit 100 for the air conditioner according to the embodiments of the present disclosure will be described below with reference to FIGS. 1-3. The air conditioner may be a single-cooling type air conditioner, or a heating-and-cooling type air conditioner, but is not limited thereto.

Figure 2:
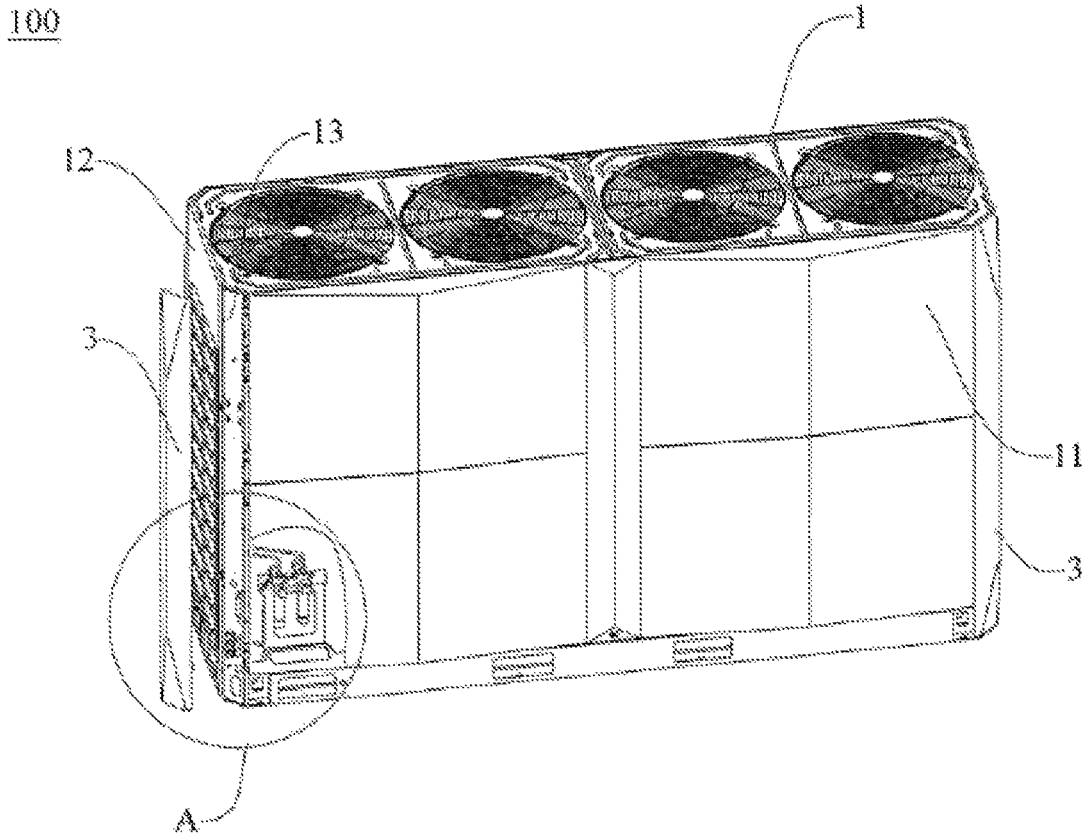
FIG. 2 is an exploded view of an outdoor unit for an air conditioner according to embodiments of the present disclosure.

As illustrated in FIGS. 1 and 2, the outdoor unit 100 for the air conditioner according to embodiments of the first aspect of the present disclosure includes the housing 1, the FREON charging nozzle 14, and the connector assembly.

Specifically, the FREON charging nozzle 14 is disposed in the housing 1. The FREON charging nozzle 14 may be configured as a FREON charging nozzle 14 on a stop valve 15, a FREON 1 charging nozzle 14 on a refrigerant charging valve, or the like. For instance, in an example of FIG. 3, the housing 1 is provided with two stop valves 15 and one refrigerant charging valve therein, each stop valve 15 is provided with one FREON charging nozzle 14, and the refrigerant charging valve is provided with one FREON charging nozzle 14. The installation personnel can add the refrigerant to the outdoor unit, detect the system pressure, or perform vacuuming through corresponding FREON charging nozzles 14. The first end of the connector assembly is connected with the FREON charging nozzle 14 and the second end of the connector assembly extends out of the housing 1. One FREON charging nozzle or a plurality of FREON charging nozzles 14 may be provided. In the case where a plurality of FREON charging nozzles 14 are provided, the connector assemblies may be in one-to-one correspondence with the FREON charging nozzles 14. Thus, the connector assembly may guide the corresponding FREON charging nozzle 14 to the outer side of the housing 1, such that the system pressure detection, the vacuuming operation, or the refrigerant adding operation can be performed at a second connector 23 without disassembling the panel 11, thereby simplifying processes of detection, installation and maintenance and improving the efficiencies of detection, installation and maintenance.

For example, in some embodiments of the present disclosure, the connector assembly includes a communication tube 21, and the communication tube 21 has a first end provided with a first connector 22 and a second end provided with the second connector 23. The first connector 22 is connected to the FREON charging nozzle 14, and the second connector 23 extends out of the housing 1.

Optionally, the first connector 22 is threadedly connected with the FREON charging nozzle 14. Specifically, the FREON charging nozzle 14 may be provided with an external thread, and the first connector 22 may be provided with an internal thread fitted with the external thread of the FREON charging nozzle 14. During the assembly, the first connector 22 can be screwed onto the FREON charging nozzle 14. The structure is simple, the installation is convenient, and the connection is reliable, which may avoid leakage of the refrigerant effectively.

According to some embodiments of the present disclosure, the communication tube 21 is configured as a copper tube. Thus, the structure strength of the communication tube 21 can be enhanced, the communication tube 21 can be prevented from being corroded, the service life of the communication tube 21 can be prolonged, and the use cost can be reduced.

Specifically, the housing 1 is provided with a lateral plate 13, the lateral plate 13 is provided with an opening portion 131, and the second connector 23 extends out of the housing 1 through the opening portion 131. The lateral plate 13 may be a lateral wall 12 of the housing 1, or may be a transition plate between the lateral wall 12 of the housing 1 and the panel 11. The opening portion 131 is formed as a through hole penetrating the lateral plate 13 in a thickness direction. Optionally, the outer contour shape of the opening portion 131 may be formed into a rectangular shape, an oblong shape, an elliptical shape, or the like.

According to some embodiments of the present disclosure, the second connector 23 includes a connector cap 231 detachably disposed to the second end of the communication tube 21. When it is necessary to perform the system pressure detection, vacuuming, or refrigerant adding operation, the connector cap 231 can be removed; after completion of the operation, the connector cap 231 can be mounted to the second end of the communication tube 21 to seal the communication tube 21 so as to avoid the leakage of the refrigerant.

Further, the connector assembly includes a fixing member 232, and the fixing member 232 may be fitted over the second end of the communication tube 21 adjacent to the second connector 23, and the fixing member 232 may be fixed to the lateral plate 13 through a threaded fastener. Thus, the position of the communication tube 21 can be stabilized, so as to reduce the shaking of the communication tube 21 when the air conditioner operates. Optionally, the threaded fastener may be a screw, a bolt, etc.

According to some embodiments of the present disclosure, the opening portion 131 has an edge provided with at least one limiting groove, and the communication tube 21 extends into the limiting groove to be fitted with the limiting groove 55. One limiting groove or a plurality of limiting grooves may be provided. Optionally, the limiting groove may be formed into a semi-circular groove. Thus, the communication tube 21 is conveniently extended into and fitted in the limiting groove, so that the movement of the communication tube 21 can be restricted by the limiting groove, thereby further stabilizing the position of the communication tube 21.

Figure 3:
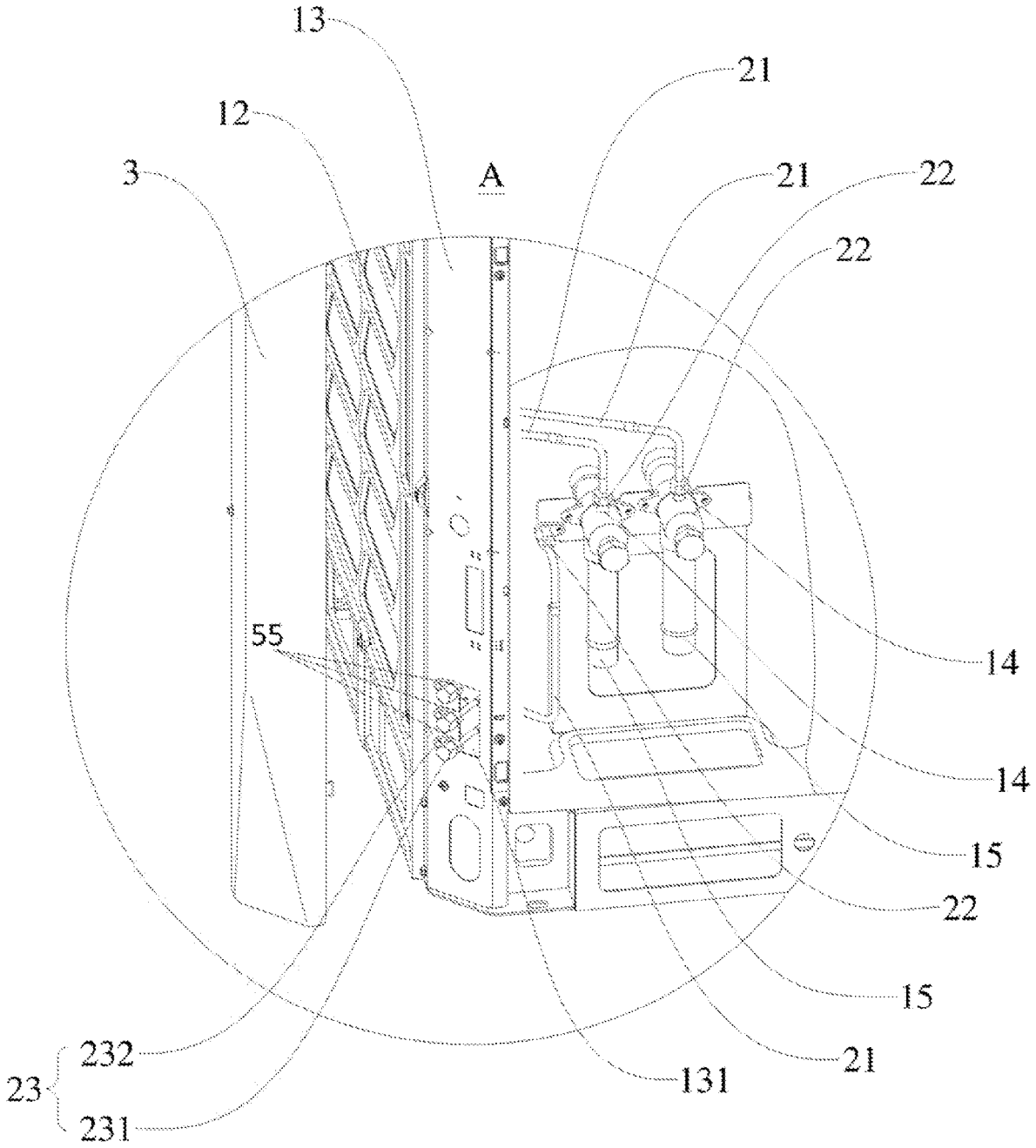
FIG. 3 is an enlarged view of part A circled in FIG. 2.

For instance, in the example of FIG. 3, a plurality of limiting grooves are provided and spaced apart in a length direction of the opening portion 131.

During the assembly, the second connector 23 may extend out of the opening portion 131, then the communication tube 21 is caught in the limiting groove, and the fixing member 232 is fixed to the lateral plate 13.

According to some embodiments of the present disclosure, the outdoor unit 100 for the air conditioner further includes a cover plate 3 detachably connected with the lateral plate 13 to cover the opening portion 131. That is, the cover plate 3 may be used to cover the opening portion 131. The cover plate 3 has a cross sectional area substantially identical to the opening portion 131 or substantially identical to a cross sectional area of the lateral plate 13, as long as the opening portion 131 can be cover, which is not specifically limited by the present disclosure. As a result, non-professionals can be prevented from touching the second connector 23, and the second connector 23 can be protected from being affected by the environment such as sunshine and rain, thereby improving the reliability of the connector assembly and prolonging the service life of the connector assembly.

Optionally, the cover plate 3 is connected with the lateral plate 13 through a screw or a snap, which makes the structure simple and the assembly or disassembly convenient. During the system pressure detection, vacuuming, or refrigerant adding operation, only the cover plate 3 needs to be removed, and the panel 11 does not need to be disassembled, thereby simplifying processes of detection, installation and maintenance and improving the efficiencies of detection, installation and maintenance.

Other configurations and operations of the outdoor unit 100 for the air conditioner according to embodiments of the present disclosure are known to those skilled in the art, and will not be elaborated herein.

A specific embodiment of the outdoor unit 100 for the air conditioner according to embodiments of the present disclosure will be described below with reference to FIGS. 1-3.

As illustrated in FIGS. 1-3, the outdoor unit 100 for the air conditioner includes the housing 1, the FREON charging nozzle 14, the connector assembly, and the cover plate 3.

The housing 1 is provided with the lateral plate 13, and the lateral plate 13 is provided with a rectangular opening portion 131. The FREON charging nozzle 14 includes two FREON freon charging nozzles 14 for two stop valves 15 and a FREON charging nozzle 14 for one refrigerant charging valve, and each FREON charging nozzle 14 is provided with one connector assembly. The connector assembly includes the communication tube 21, and the first end of the communication tube 21 is provided with the first connector 22 while the second end of the communication tube 21 is provided with the second connector 23. The first connector 22 is threadedly connected with the FREON charging nozzle 14, and the second connector 23 extends out of the housing 1 through the opening portion 131.

The second connector 23 includes the connector cap 231 and the fixing member 232, the connector cap 231 is detachably disposed to the second end of the communication tube 21, and the fixing member 232 may be fixed to the lateral plate 13 through a threaded fastener. The edge of the opening portion 131 is provided with a plurality of limiting grooves spaced apart in the length direction of the opening portion 131, and the communication tube 21 extends into the limiting groove and is fitted with the limiting groove.

The cover plate 3 is connected with the lateral plate 13 through a snap, and the cross sectional area of the cover plate 3 is substantially identical to that of the lateral plate 13.

For the outdoor unit 100 for the air conditioner according to the embodiments of the present disclosure, the system pressure detection, the vacuuming operation, or the refrigerant adding operation can be performed at the second connector 23 without disassembling the panel 11, thereby simplifying processes of detection, installation and maintenance and improving the efficiencies of detection, installation and maintenance.

An air conditioner according to embodiments of a second aspect of the present disclosure includes the outdoor unit 100 according to the embodiments of the first aspect of the present disclosure.

For the air conditioner according to embodiments of the second aspect of the present disclosure, the installation and maintenance efficiencies of the air conditioner is improved by providing the outdoor unit 100 according to the embodiments of the first aspect of the present disclosure.

Reference throughout this specification to "an embodiment," "some embodiments," "an illustrative embodiment," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although embodiments have been shown and described, it would be appreciated by those skilled in the art that changes, modifications, alternatives, and variations can be made in the above embodiments without departing from the principle and purpose of the present disclosure. The scope of the present disclosure is defined by the claims or the like.

What is claimed is:

1. An outdoor unit for an air conditioner, comprising:

a housing;

a refrigerant charging nozzle provided in the housing;

a connector assembly having a first end connected with the refrigerant charging nozzle and a second end extending out of the housing;

a communication tube having a first end provided with a first connector and a second end provided with a second connector, the first connector is connected with the refrigerant charging nozzle, and the second connector extends out of the housing, wherein the second connector comprises a fixing member and a connector cap;

a lateral plate, the lateral plate provided with an opening portion; and a cover plate detachably connected with the lateral plate to cover the opening portion and the connector cap, wherein the second connector extends out of the housing through the opening portion, wherein the opening portion having an edge provided with at least one limiting groove, wherein the communication tube extends into the at least one limiting groove and is fitted with the at least one limiting groove, and wherein the connector cap and the cover plate are removed for a system pressure detection, a vacuuming, or a refrigerant adding operation.

2. The outdoor unit according to claim 1, wherein a plurality of the at least one limiting grooves is provided and spaced apart in a length direction of the opening portion.

3. The outdoor unit according to claim 1, wherein the cover plate is connected with the lateral plate through a screw or a snap.

4. The outdoor unit according to claim 1, wherein the first connector is threadedly connected with the refrigerant charging nozzle.

5. The outdoor unit according to claim 1, wherein the communication tube is configured as a copper tube.

6. An air conditioner, comprising an outdoor unit according to claim 1.

7. The outdoor unit according to claim 2, wherein the first connector is threadedly connected with the refrigerant charging nozzle.

8. The outdoor unit according to claim 3, wherein the first connector is threadedly connected with the refrigerant charging nozzle.

9. The outdoor unit according to claim 1, wherein a stop valve is provided with the refrigerant charging nozzle.

10. The outdoor unit according to claim 1, wherein the system pressure detection, the vacuuming operation, or the refrigerant adding operation is performed at the second connector.

11. The outdoor unit according to claim 1, wherein an installation personnel adds the refrigerant to the outdoor unit to detect the system pressure, or perform vacuuming through corresponding the refrigerant charging nozzle.

12. The outdoor unit according to claim 1, wherein the lateral plate is a lateral wall of the housing separated from a panel of the housing.

13. The outdoor unit according to claim 12, wherein the cover plate is removed for system pressure detection, vacuuming, or refrigerant adding operation without dissembling the panel of the housing.

14. The outdoor unit according to claim 1, wherein the cover plate has a cross sectional area substantially identical to the opening portion or substantially identical to a cross sectional area of the lateral plate.

* * * * *